United States Patent [19]

Wise et al.

[11] 4,176,080

[45] Nov. 27, 1979

[54] DETERGENT COMPOSITIONS FOR EFFECTIVE OILY SOIL REMOVAL

[75] Inventors: Rodney M. Wise; Sharon J. Mitchell, both of Cincinnati, Ohio

[73] Assignee: The Procter & Gamble Company, Cincinnati, Ohio

[21] Appl. No.: 839,221

[22] Filed: Oct. 3, 1977

[51] Int. Cl.[2] ..... C11D 7/24

[52] U.S. Cl. ..... 252/162; 252/170; 252/172; 252/104; 252/111; 252/114; 252/118; 252/122; 252/139; 252/153; 134/40; 8/137; 8/142

[58] Field of Search ..... 252/162, 170, 172, 104, 252/111, 114, 118, 122, 139, 153; 134/40; 8/137, 142

[56] References Cited

U.S. PATENT DOCUMENTS 3,926,831 12/1975 Sonnengruber ..... 8/142 X

*Primary Examiner*—Mayer Weinblatt

*Attorney, Agent, or Firm*—Edmund F. Gebhardt; Thomas H. O'Flaherty; Richard C. Witte

[57] ABSTRACT

Compositions and methods for removing oily soils from fabrics involving treatment with specific mixtures of solvents and solvent soluble emulsifiers in an aqueous washing medium followed by treatment with specified surface active agents to remove retained solvent from fabrics. The compositions herein can be employed singly in aqueous washing media to remove oily materials from fabrics or can be admixed with other materials suitable for use in a laundry procedure.

14 Claims, No Drawings

DETERGENT COMPOSITIONS FOR EFFECTIVE OILY SOIL REMOVAL

BACKGROUND OF THE INVENTION

Field of the Invention

This invention relates to compositions and methods for removing oily soils from fabrics. More particularly, the invention relates to the use of specific mixtures of water-insoluble solvents and solvent soluble emulsifiers in aqueous washing media followed by treatment with a composition incorporating a surface active agent (surfactant) to remove residual solvent from the fabrics.

Current laundry products and procedures exhibit one or more deficiencies when used to clean oil stains, particularly hydrocarbon stains, from fabrics. Fatty triglyceride soils, especially those arising from natural body secretions, present another type of oily stain which is difficult to remove from modern fabrics by means of simple aqueous laundering processes. Such deficiencies are especially apparent when polyester or polyester-cotton fabric blends soiled with various oily materials are laundered in aqueous laundry baths.

Heretofore, effective oil removal from modern fabrics has largely been accomplished by means of relatively inconvenient and expensive methods involving non-aqueous dry cleaning processes. Another approach for removal of oily stains has been pretreatment of soiled areas of fabrics with liquid detergents or specific pretreatment compositions prior to normal laundering. This approach has not proven entirely satisfactory. It is not always practical to identify the fabric areas which need special attention prior to laundering. Results are often disappointing. Accordingly, compositions and methods which would provide economical and efficient removal of oily soils from fabrics employing conventional household laundry equipment are desirable.

The present invention employs a sequential treatment of fabrics in an aqueous washing medium with first, a water-insoluble solvent containing about 3% to about 30% of a solvent soluble water-in-oil emulsifier typically having an hydrophilic lipophilic balance (HLB) value of from about 2 to about 12, and second, a composition comprising a water soluble surfactant typically having an HLB value of from about 11 to about 18.

State of the Art

Water-insoluble solvents containing surfactants have been described. Typical utilities for such compositions are dry cleaning, hard surface cleaning, and as bases for insecticide compositions. U.S. Pat. Nos. 2,271,635; 2,326,772; 2,327,182; and 2,327,183 disclose dry cleaning solvents containing small amounts of water or having the ability to emulsify small amounts of water because of the content of surfactants. This aids in the removal of water-soluble soils. Surfactants and emulsifiers disclosed respectively in these patents are alkyl sulfates, alkyl benzene sulfonates, and sulfonated aliphatic carboxylate-alcohol esters. The disclosed surfactant levels are below 1% based on the weight of solvent used in the dry cleaning process.

U.S. Pat. No. 3,101,239 (Warren et al) discloses Stoddard solvent containing 1.5% to 3% of dioctyl sodium sulfosuccinate.

U.S. Pat. No. 3,277,013 (Gianladis) discloses waterless skin cleaners containing mineral oil or deodorized kerosene and an ethoxylated nonionic surfactant. The preferred surfactant level is about 15% based on mineral oil or kerosene.

U.S. Pat. No. 3,352,790 (Sugarman) discloses dry cleaning solvents containing 0.2 to 10% of a phosphate ester of an alkoxylated nonionic.

U.S. Pat. No. 3,645,906 (Valenta et al) discloses water solvent emulsions containing 15% to 30% of alkylated diphenyl oxide sulfonates.

U.S. Pat. No. 3,707,506 (Lozo) discloses aqueous washing solutions containing 0.01 to 5% of detergent compositions comprising 20 to 80% of a generally water-soluble monoalkyl nonionic surfactant and 80 to 20% kerosene.

U.S. Pat. No. 3,962,151 (Dekker) discloses kerosene containing cationic emulsifiers and optionally nonionic detergents. The utility is hard surface cleaning involving removal of the kerosene and soil with a water flush.

While the use of various water-insoluble solvent and surfactant or emulsifier mixtures is known, the detergent arts have not heretofore recognized that certain combinations of solvents and solvent soluble poly long chain alkyl emulsifiers provide exceptional cleaning of fabrics with oily soils in an aqueous medium, especially when the addition of this composition to the aqueous medium is followed by the subsequent addition of a composition comprising a water soluble surfactant with an HLB value of from about 11 to about 18. It has now been discovered that certain properly formulated mixtures of water-insoluble solvents and solvent soluble water-in-oil emulsifiers typically with an HLB value of from about 2 to about 12 are especially useful in aqueous media for solubilizing oily soils and removing the same from fabrics, particularly fabrics containing polyester fibers. In the practice of this invention the addition of this oily soil dissolving agent composition, comprising solvent and emulsifier, to the aqueous washing medium is followed by the addition of a second solvent stripping agent composition comprising a surfactant with an HLB value of from about 11 to about 18. The combined treatment provides cleaning of oily soils from fabrics comparable to that obtained in a typical dry cleaning process. The compositions herein are characterized by the speed with which they remove oily soils from fabrics; hence they are useful for cleaning fabrics in the relatively limited time available in the cleaning cycle of a home laundering operation.

The oily soil solubilization step can be accomplished in as short a time as 30 seconds even in cool water. Removal of retained solvent by use of the solvent stripping agent also takes place rapidly, easily with the fine fabric or wash wear cycle of automatic washing machines.

It is an object of the present invention to provide compositions and methods for removing oily soil from fabrics in a home laundry operation.

A further object of this invention is to provide a prepackaged cleaning product which contains the two cleaning compositions of the invention in discrete units suitable for sequential addition to an aqueous washing medium. A still further object herein is to provide compositions which additionally comprise fabric care ingredients for providing or restoring a desirable fabric texture.

These and other objects are obtained herein, as will be seen by the following disclosure.

SUMMARY OF THE INVENTION

The present invention encompasses a prepackaged cleaning product for removing oily soil from fabrics in an aqueous washing medium comprising:

(1) a discrete unit of an oily soil dissolving agent comprising:

(a) from about 20% to about 97% of a water insoluble solvent selected from the group consisting of:

(i) alkanes or alkenes having a flash point not lower than 65° C. (Tag closed cup), an initial boiling point not lower than about 130° C., and a solidification point not above about 20° C.; and (ii) fatty acid esters of the formula $$R_1-\overset{\overset{\displaystyle O}{\|}}{C}-OR_2$$

in which $R_1$ is an alkyl group with from about 7 to about 17 carbon atoms and $R_2$ is an alkyl group with from 1 to about 10 carbon atoms, the sum of carbon atoms in $R_1$ and $R_2$ being from about 8 to about 23; and (b) from about 3% to about 30% by weight of a water-in-oil emulsifier soluble in said solvent having an HLB value of from about 2 to about 12 and comprising from about 25% to 100% of emulsifier compounds with at least two alkyl groups each having at least about 9 carbon atoms.

(2) a discrete unit of a solvent stripping agent comprising about 5% to 100% of a water soluble surfactant having an HLB value of from about 11 to about 18, said discrete unit comprising from about 10% to about 80% by weight of the total cleaning product, said discrete unit of solvent stripping agent being adapted for entry to said aqueous washing medium at least about 30 seconds after entry of said discrete unit of oily soil dissolving agent.

Preferably, the discrete units are the amount of oily soil dissolving agent and solvent stripping agent suitable for a single cleaning procedure. A preferred weight range for discrete units of oily soil dissolving agent is from about 75 grams to about 1000 grams, more preferably from about 200 grams to about 800 grams. A preferred weight range for discrete units of solvent stripping agent is from about 50 grams to about 1000 grams, more preferably from about 100 grams to about 500 grams. These weight ranges are suitable for use in a typical upright automatic washing machine with a water capacity of 10 to 15 gallons.

The oily soil dissolving agent is added to an aqueous washing medium at a concentration of about 0.1% to about 3% by weight of the aqueous washing medium. The solvent stripping agent is added to provide a concentration from about 0.01% to about 1% by weight of a water-soluble surfactant having an HLB value of from about 11 to about 18 in the aqueous medium. The compositions herein may contain additional ingredients to provide removal of other types of soils or to provide fabric care properties so long as these ingredients are compatible with the essential ingredients.

DETAILED DESCRIPTION OF THE INVENTION

The oily soil effective detergent compositions herein comprise three essential ingredients; a solvent suitable for use in a household washing machine, a water-in-oil emulsifier soluble in said solvent, having an HLB value of from about 2 to about 12 and at least about 25% by weight of emulsifier compounds having more than one long chain hydrophobic group, and a water soluble surfactant compounded separately from said solvent and said solvent soluble emulsifier, said surfactant having an HLB value of from about 11 to about 18. The water soluble surfactant is added or otherwise released to the aqueous washing medium, or alternately to an aqueous rinsing medium, at least about 30 seconds after addition of the oily soil dissolving agent comprising a solvent and a solvent soluble emulsifier.

Solvent

The choice of a solvent for the practice of this invention is based on performance considerations, but limited by considerations of safety and acceptability for use in home laundry equipment. Flammability considerations require use of only those hydrocarbon solvents that will not be easily flammable in either the undiluted product form or as used in an aqueous washing medium. This excludes "naphtha" and Stoddard Solvent with flash points below about 40° C. to 50° C. Halogenated solvents do not have any substantial flammability problem but are undesirable for home use because of odor and biological safety considerations. Although the oily soil dissolving agent comprising the solvent and solvent-soluble emulsifier is water insoluble, the oily soil dissolving agent should be temporarily dispersible in the aqueous washing medium so as to provide the opportunity of contact of the solvent phase with all the fabric surface in the aqueous washing medium. A composition containing a specified solvent and a suitable solvent soluble emulsifier is substantive to fabrics, particularly those of a hydrophobic nature such as polyester fabrics, and the composition partially replaces adsorbed water on the fabrics.

Solvents which meet the criteria discussed above are: (1) alkanes and alkenes having a flash point not lower than about 65° C., and specified boiling point and solidification point characteristics, and (2) specified fatty acid esters.

The alkanes and alkenes suitable for use in the practice of the invention have a flash point not lower than about 65° C., preferably not lower than about 90° C. (Tag closed cup test), an initial boiling point not lower than about 130° C., and a solidification point not above about 20° C. In general, the preferred alkanes that meet these criteria will be aliphatic hydrocarbons having the generic formula $C_nH_{2n+2}$, in which n is from about 10 to about 18 (i.e., the aliphatic series decane through octadecane). Although single compounds are suitable for use in this invention, most commercially available solvents that meet the boiling point and distillation point criteria will be mixtures of aliphatic hydrocarbons. Examples of suitable commercially available materials are Paraffin F (Exxon), Isopar (Exxon), Varsol (Exxon), Norpar (Exxon), 95% dodecane, and kerosene, especially deodorized kerosene.

Kerosene is a mixture of petroleum hydrocarbons comprising principally alkanes having from 10 to 16 carbon atoms per molecule. It constitutes the fifth fraction in the distillation of petroleum, being collected after the petroleum ethers and before the oils. Although kerosene is comprised mainly of alkanes, a typical kerosene also includes alkyl derivatives of benzene and naphthalene. Kerosene particularly suitable for use in this invention is deodorized and decolorized by washing with sulfuric acid followed by treatment with sodium plumbite solution and sulfur.

The use of alkanes containing substantial molecular species with carbon chain lengths over about 18 is undesirable because of a tendency to distribute poorly in the aqueous washing medium. In general, any alkane/alkene mixture should be freely pourable at 20° C. In general, suitable alkanes will have a density at 20° C. lower than about 0.8.

The fatty acid esters suitable as solvents for this invention are described herein. Particularly suitable are the methyl, ethyl, and propyl esters of fatty acids with a carbon chain length of from about 8 to about 18.

The Solvent Soluble Emulsifier

The solvent soluble water-in-oil emulsifiers suitable for incorporation in the solvents described above may be from any of the usual classes of emulsifiers such as anionic, nonionic, zwitterionic, amphoteric, and cationic.

The essential characteristics of this emulsifier are solubility in the solvent employed, an HLB value of from about 2 to about 12 and about a 25% to 100% content of emulsifier compounds with at least two alkyl groups each having at least about 9 carbon atoms. In general, these characteristics are not independent; a relatively low HLB value is predictive of solubility in the solvents of this invention and a poly-long chain alkyl structure tends to provide both solvent solubility and low HLB values. Preferred emulsifiers have a relatively low water solubility and consequently will tend to partition preferentially to the solvent phase of a two phase solvent-water system. As described more fully below, particularly preferred emulsifiers with two or more long chain alkyl groups, are dialkyl sulfosuccinic acid esters, salts of diesters of phosphoric acid and quaternary ammonium salts with two or three long chain alkyl groups.

The effectiveness of emulsifiers and surfactants as water-in-oil or oil-in-water emulsifiers, wetting agents or solubilizing agents can be predicted by the HLB value of the surfactant or emulsifier. This relates to the principle that the emulsifying efficiency of a given compound is associated with the polarity of the molecule. The contribution of the polar hydrophilic head of the molecule and the non-polar lipophilic tail is represented by a scale in which the least hydrophilic material has low HLB numbers while high HLB numbers correspond to increased water solubility. The HLB value of surfactants or emulsifiers can be determined experimentally in a well known fashion. The HLB value of compounds in which the hydrophilic portion of the molecule is principally an alkylene oxide, such as ethylene oxide, can be estimated by the weight ratio of alkylene oxide portion to the lipophilic portion (e.g., a hydrocarbyl radical). In general, surfactants or emulsifiers with an HLB number below some value in the range of 10 through 12 will be soluble or dispersible in the solvents of the present invention, but poorly soluble in water. The critical HLB value for solvent solubility varies somewhat with molecular structure. Surfactants with an HLB number above about 11 will be water soluble or dispersible and tend to be insoluble in solvents. Low HLB value compounds promote the formation of water-in-oil emulsions while high HLB value compounds promote the formation of oil-in-water emulsions. In the practice of the present invention it is undesirable initially to form highly stable oil-in-water emulsions of the oily soil dissolving agent in the aqueous washing medium. The composition is not sufficiently fabric substantive when dispersed in water in the presence of surfactants with HLB values above about 11 or 12.

Preferred solvent soluble anionic surfactants having an HLB value of from about 2 to about 12 for the practice of the invention are the salts of dialkyl esters of sulfosuccinic acids, wherein the alkyl groups contain from about 9 to about 20 carbon atoms, and the alkyl and alkyl polyethoxy diesters of phosphoric acid. Specific examples of suitable sulfosuccinic acid esters are sodium (bis)decyl sulfosuccinate and sodium (bis)tridecyl sulfosuccinate.

Diesters of phosphoric acid useful in the practice of this invention generally have the formula:

(H or salt forming cation)

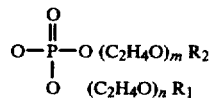

in which both $R_1$ and $R_2$ have carbon chain lengths of from about 9 to about 20 and in which n and m are from zero to about 8. Commercially available diesters of phosphoric acid are usually mixtures of mono- and diesters. In the practice of the present invention, at least about 25% of the total solvent soluble emulsifier compounds should have at least two relatively long chain alkyl groups such as provided by the diester.

Although a preferred form of anionic emulsifier is a neutralized salt (e.g., alkali metal, alkaline earth metal, ammonium, or mono-, di-, and tri-$C_{1-4}$ alkyl and alkanol ammonium salt), the unneutralized acid form of anionic emulsifiers can be employed. Mixtures of all of the above emulsifiers can be employed.

Preferred cationic surfactants for the practice of this invention are quaternary ammonium compounds with more than one long chain alkyl (e.g. $C_{9-20}$) group such as ditallowdimethyl ammonium chloride, bromide, methyl sulfate, nitrate, acetate, etc., and dialkyl imidazolinium quaternary ammonium compounds such as methyl-1-stearylamido-ethyl-2-stearlamidoimidazolinium methyl sulfate, chloride, bromide, nitrate, acetate, etc.

Water Soluble Surfactant

The water soluble relatively high HLB surfactant used in the practice of this invention is characterized by water solubility and an HLB value of from about 11 to about 18. Water soluble surfactants in this HLB range generally have the ability to form stable oil-in-water emulsions or even clear dispersions of oil or solvents in water. As discussed above the initial presence of water soluble surfactants with HLB values above about 11 adversely affects the substantivity of the solvent to fabrics in the aqueous washing medium. Adsorption of the oily soil dissolving agent comprising solvent and the solvent soluble emulsifier proceeds rapidly, however, and the water soluble surfactant may enter or be added to the aqueous washing medium at any interval of at least about 30 seconds after addition of the oily soil solvent composition. A delay of from about 2 to about 5 minutes is optimum from the standpoints of performance and convenience. Any method of obtaining this delay is acceptable. In one embodiment of this invention, the oily soil dissolving agent and the solvent stripping agent are separately compounded and packaged. In another embodiment of this invention the solvent stripping agent comprising a water soluble surfactant is compounded with the oily soil dissolving agent, but is restrained from mixing with the oily soil dissolving agent and restrained from immediate release into the aqueous washing medium by a coating, or matrix, of solvent insoluble material. Desirably, such coating or matrix shall also have the ability to delay effective addition of the solvent stripping agent to the aqueous washing medium until at least about 30 seconds after the total composition is added to the aqueous washing medium containing the fabrics to be cleaned.

The water soluble surfactant of this invention having an HLB value of from about 11 to about 18 may be selected from the usual classes of surfactants, namely, anionics, nonionics, zwitterionics, amphoteric, and cationic surfactants. Suitable surfactants may be a mixture of various classes of detergents although the combination of anionic and cationic surfactants may present compatibility problems. The water soluble surfactants can be selected from the surfactants disclosed hereinafter and mixtures thereof, so long as the HLB limits are observed for the total water soluble surfactant system.

Water soluble high HLB anionic surfactants suitable for use in the practice of this invention include alkali metal soaps and the alkali metal, alkaline earth metal, ammonium, and substituted ammonium salts of organic sulfuric reaction products. Examples of salts of organic sulfuric reaction products are sodium alkyl sulfate and sodium alkyl benzene sulfonate wherein the alkyl group contains from about 10 to about 20 carbon atoms. Other preferred surfactants of this class are paraffin sulfonates and olefin sulfonates in which the alkyl or alkenyl group contains from about 10 to about 20 carbon atoms.

Other preferred water soluble anionic surfactants useful herein are alkyl ether sulfates having the formula $RO(C_2H_4O)_xSO_3M$ wherein R is alkyl or alkenyl of about 10 to about 20 carbon atoms, x is 1 to 30, and M is a water-soluble cation. The alkyl ether sulfates useful in the present invention are condensation products of ethylene oxide and monohydric alcohols having about 10 to about 20 carbon atoms. Preferably, R has 12 to 18 carbon atoms. The alcohols can be derived from natural fats, e.g., coconut oil or tallow, or can be synthetic. Such alcohols are reacted with 1 to 30, and especially 3, molar proportions of ethylene oxide and the resulting mixture of molecular species is sulfated and neutralized.

Specific examples of alkyl ether sulfates of the present invention are sodium coconut alkyl triethylene glycol ether sulfate, lithium tallow alkyl triethylene glycol ether sulfate, and sodium tallow alkyl hexaoxyethylene sulfate. Preferred alkyl ether sulfates are those comprising a mixture of individual compounds, said mixture having an average alkyl chain length of from about 12 to 16 carbon atoms and an average degree of ethoxylation of from about 1 to 4 moles of ethylene oxide.

Additional examples of anionic surfactants useful herein are the compounds which contain two anionic functional groups. These are referred to as di-anionic surfactants. Suitable dianionic surfactants are the disulfonates, disulfates, or mixtures thereof which may be represented by the following formula:

$$R(SO_3)_2M_2, R(SO_4)_2M_2, R(SO_3)(SO_4)M_2$$

where R is an acyclic aliphatic hydrocarbyl group having 15 to 20 carbon atoms and M is a water-solubilizing cation, for example, the $C_{15}$ to $C_{20}$ disodium 1,2-alkyldisulfates, $C_{15}$ to $C_{20}$ dipotassium-1,2-alkyldisulfonates or disulfates, disodium 1,9-hexadecyl disulfates, $C_{15}$ to $C_{20}$ disodium 1,2-alkyldisulfonates, disodium 1,9-stearyldisulfates and 6,10-octadecyldisulfates.

Water soluble nonionic surfactants having an HLB value of from about 11 to about 18 and useful herein include:

1. The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds may be derived, for example, from polymerized propylene or isobutylene, octene or nonene. Examples of compounds of this type include nonyl phenol condensed with about 9.5 moles of ethylene oxide per mole of nonyl phenol and dodecyl phenol condensed with about 12 moles of ethylene oxide per mole of dodecyl phenol. Commercially available nonionic surfactants of this type include Igepal CO-610 marketed by the GAF Corporation, and Triton X-45, X-114, X-100 and X-102, all marketed by the Rohm and Haas Company.
2. The condensation products of aliphatic alcohols with ethylene oxide. The alkyl chain of the aliphatic alcohol may either by straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above described coconut alcohol. Examples of commercially available nonionic surfactants of this type include Tergitol 15-S-9 marketed by the Union Carbide Corporation, Neodol 23-6.5 marketed by the Shell Chemical Company.
3. The condensation products of ethylene oxide with a hydrophobic base formed by the condensation of propylene oxide with propylene glycol. The hydrophobic portion of these compounds has a molecular weight of from about 1500 to 1800 and exhibits water insolubility. The addition of at least about 30% by weight of polyoxyethylene moieties to this hydrophobic portion provides water-solubility to the molecule. Examples of compounds of this type include certain of the commercially available Pluronic surfactants marketed by the Wyandotte Chemicals Corporation.

4. The condensation products of ethylene oxide with the product resulting from the reaction of propylene oxide and ethylenediamine. The hydrophobic base of these products consists of the reaction product of ethylenediamine and excess propylene oxide, said base having a molecular weight of from about 2500 to about 3000. This base is condensed with ethylene oxide to the extent that the condensation product contains from about 40 to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.
5. Surfactants having the formula $R^1R^2R^3N \rightarrow O$ (amine oxide surfactants) wherein $R^1$ is an alkyl group containing from about 10 to about 18 carbon atoms, from 0 to about 2 hydroxy groups and from 0 to about 5 ether linkages, there being at least one moiety of $R^1$ which is an alkyl group containing from about 10 to about 18 carbon atoms and no ether linkages, and each $R^2$ and $R^3$ is selected from the group consisting of alkyl groups and hydroxyalkyl groups containing from 1 to about 3 carbon atoms. Specific examples of amine oxide surfactants include: dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide bis-(2-hydroxyethyl)dodecylamine oxide, bis(2-hydroxyethyl)-3-dodecoxy-2-hydroxypropylamine oxide, (2-hydroxypropyl)methyltetradecylamine oxide, dimethyloleylamine oxide, dimethyl-(2-hydroxydodecyl)amine oxide, and the corresponding decyl, hexadecyl and octadecyl homologs of the above compounds.

Ampholytic synthetic detergents can be broadly described as derivatives of aliphatic, or alkyl substituted hetero cyclic, secondary and tertiary amines in which the aliphatic radical may be straight chain or branched and wherein one of the aliphatic substituents contains from about 8 to 18 carbon atoms and at least one contains an anionic water-solubilizing group, e.g., carboxy, sulfonate, sulfate. Examples of compounds falling within this definition are sodium 3-(dodecylamino)propionate, sodium 2-(dodecylamino)ethyl sulfate, sodium 2-(dimethylamino)octadecanoate, disodium 3-(N-carboxymethyldodecylamino)propane-1-sulfonate, disodium octadecyl-iminodiacetate, sodium 1-carboxymethyl-2-undecylimidazole, and sodium N,N-bis(2-hydroxyethyl)-2-sulfato-3-dodecoxy-propylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent attached to an "onium" atom and containing an anionic water-solubilizing group, e.g., carboxy, sulfonate, sulfate, phosphate, or phosphonate. Examples of zwitterionic surfactants include 3-(N,N-dimethyl-N-hexadecylammonio)-propane-1-sulfonate; 3-(N,N-dimethyl-N-hexadecylammonio)-2-hydroxypropane-1-sulfonate; N,N-dimethyl-N-dodecylammonio acetate; 3-(N,N-dimethyl-N-dodecylammonio)propionate; 2-(N,N-dimethyl-N-octadecylammonio)ethyl sulfate; 3-(P,P-dimethyl-P-dodecylphosphonio)propane-1-sulfonate; 2-(S-methyl-S-tert-hexadecylsulfo)ethane-1-sulfonate; 3-(S-methyl-S-dodecylsulfonio)propionate; N,N-bis(oleylamidopropyl-N-methyl-N-carboxymethylammonium betaine; N,N-bis(stearamidopropyl)-N-methyl-N-carboxymethylammonium betaine; N-(stearamidopropyl)-N-dimethyl-N-carboxymethylammonium betaine; 3-(N-4-n-dodecylbenzyl-N,N-dimethylammonio)propane-1-sulfonate; and 3-(N-dodecylphenyl-N,N-dimethylammonio)-propane-10- sulfonate.

Cationic surfactants having water solubility and an HLB value of from about 11 to about 18, are useful in the practice of this invention. Particularly useful are cationic surfactants in mixtures with nonionic surfactants as disclosed in copending commonly assigned U.S. Ser. Nos. 811,219; 811,220 and 811,221 all filed June 29, 1977.

Examples of useful water soluble cationic surfactants are trimethyldodecyl ammonium chloride and the condensation product of a primary fatty amine having a chain length of 12 to 18 carbon atoms with 5 to 15 moles of ethylene oxide.

Adjuvant Materials

The oily soil dissolving agent comprising a solvent and solvent soluble emulsifier and the solvent stripping agent comprising a water soluble surfactant need not contain other ingredients for effective oily soil removal from fabrics. Either composition may, however, optionally contain other materials, for example, from 0% to about 77% in the oily soil dissolving agent and from 0% to about 95% in the solvent stripping agent. Detergency builders are useful adjuvants. Such builders can be employed in the oily soil dissolving agent at concentrations of from 0% to about 77% by weight and in the solvent stripping agent at concentrations of from 0% to about 95% by weight. Useful builders herein include any of the conventional inorganic and organic builder salts.

Such detergency builders can be, for example, water soluble salts of phosphates, pyrophosphates, orthophosphates, polyphosphates, phosphonates, carbonates, polyhydroxysulfonates, silicates, polyacetates, carboxylates, polycarboxylates and succinates. Specific examples of inorganic phosphate builders include sodium and potassium tripolyphosphates, pyrophosphates, and hexametaphosphates. The polyphosphonates specifically include, for example, the sodium and potassium salts of ethylene diphosphonic acid, the sodium and potassium salts of ethane 1-hydroxy-1,1-diphosphonic acid and the sodium and potassium salts of ethane-1,1,2-triphosphonic acid. Examples of these and other phosphorous builder compounds are disclosed in U.S. Pat. Nos. 3,159,581; 3,213,030; 3,422,021; 3,422,137; 3,400,176 and 3,400,148, incorporated herein by reference.

Non-phosphorus containing sequestrants can also be selected for use herein as detergency builders.

Specific examples of non-phosphorus, inorganic builder ingredients include water-soluble inorganic carbonate, bicarbonate, and silicate salts.

Water-soluble, organic builders are also useful herein. For example, the alkali metal, ammonium and substituted ammonium polyacetates, carboxylates, polycarboxylates and polyhydroxysulfonates are useful builders in the present compositions and processes. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Preferred non-phosphorous builder materials herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Other preferred builders herein are the polycarboxylate builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid and methylenemalonic acid.

Additionally, preferred builders herein include the water-soluble salts, especially the sodium and potassium salts, of carboxymethyloxymalonate, carboxymethyloxysuccinate, cis-cyclohexanehexacarboxylate, cis-cyclopentanetetracarboxylate and phloroglucinol trisulfonate.

A further class of detergent builders are certain insoluble aluminosilicates. Detergent compositions incorporating these aluminosilicate materials are disclosed in Belgian Patent No. 814,874 issued Nov. 12, 1974, the disclosures of which are herein incorporated by reference.

The compositions herein can also optionally contain all manner of additional materials commonly found in laundering and cleaning compositions including diluents such as water and inert inorganic salts. Thickeners and soil suspending agents such as carboxymethyl-cellulose and the like can be included in the compositions. Enzymes, especially the thermally stable proteolytic and lipolytic enzymes commonly used in high temperature laundry detergent compositions, can also be present herein. Various perfumes, optical bleaches and the like can be present to provide the usual benefits occasioned by the use of such materials in detergent compositions. Oxygen bleaches can also be present as a component of the compositions herein. It is to be recognized that the addition of all such adjuvant materials is practical, inasmuch as they are compatible and stable in the compositions herein.

The solvent stripping agent may additionally comprise adjuvants useful in the context of the care or treatment of fabrics.

In a preferred embodiment the solvent stripping agent comprises from about 0.5% to about 15% of a fabric sizing agent such as gelatinized or partially gelatinized starch. Particularly preferred are gelatinized or partially gelatinized natural starches such as partially gelatinized corn starch. Additional examples of sizing agents and starches suitable for use in the practice of the present invention are those materials disclosed in U.S. Pat. No. 2,702,755 issued to Chaney Feb. 22, 1955; U.S. Pat. No. 2,999,031 issued to Katzback Sept. 5, 1961; and U.S. Pat. No. 3,332,795 issued to Black et al July 25, 1967, the disclosures of which are incorporated herein by reference. This provides or restores a body to the treated fabrics that is associated with new fabrics or garments. In an especially preferred embodiment the solvent stripping agent comprises a fabric conditioning agent selected from fabric softening agents and antistatic agents. Quaternary ammonium compounds such as ditallow dimethyl ammonium chloride and certain imidazolinium compounds, e.g., methyl-1-stearylamidoethyl-2-stearylamidoimidazolinium methyl sulfate, provide both fabric softening and an antistatic benefit. Other fabric softening and antistatic agents suitable for incorporation in the solvent stripping agent are disclosed in U.S. Pat. No. 4,018,688 issued to Pracht et al Apr. 19, 1977 incorporated herein by reference. It should be recognized that compatibility considerations can limit the incorporation of cationic softeners and cationic anti-static agents into solvent stripping agents comprising anionic surfactants. A preferred level of a quaternary ammonium compound in the solvent stripping agent is from about 0.1% to about 3%. The use of a fabric softening agent in combination with a fabric sizing agent is particularly desirable. The resulting fabric texture can be described as having "body" without stiffness.

Other adjuvants useful in the solvent stripping agent composition are soil release polymers such as ethylene oxide terphthalate co-polymers and hydroxybutyl cellulose. Soil release agents are usefully present at concentrations up to 50% by weight of solvent stripping agent or at a concentration of from about 0.01% to about 1%, preferably about 0.1%, by weight of the aqueous washing medium.

In the method and aqueous washing medium composition aspect of the present invention the solvent selected from alkanes, alkenes and fatty acid esters as defined above should be present at a concentration by weight of from about 0.1% to about 3% in the aqueous washing medium. A concentration range of from about 0.2% to about 1.2% is preferred and a concentration of about 0.8% is most preferred. The solvent soluble emulsifier should be present in a concentration of from about 0.01% to about 0.5%, preferably from about 0.02% to about 0.2% and most preferably about 0.1%. The water soluble surfactant component of the solvent stripping agent should be subsequently added or released to provide a concentration of from about 0.01% to about 1% in the aqueous washing medium; preferably the concentration of this surfactant is from about 0.02% to about 0.5%, and most preferably from about 0.05% to about 0.15%.

When utilized, a fabric sizing agent can be added or released to the aqueous washing medium at a concentration of from about 0.005% to about 0.5% by weight, a quaternary ammonium fabric softening and antistatic agent can be added or released to the aqueous washing medium at a concentration of from 0% to about 0.1% by weight, and a soil release agent such as an ethylene oxide terephthalate copolymer or hydroxybutyl cellulose can be added at a concentration of from 0% to about 1% by weight. Preferably these fabric care materials are added with the water-soluble surfactant or at any time thereafter. Addition of fabric care ingredients can be in a separate aqueous medium such as a rinse.

EXAMPLE I

Swatches of polyester knit and polyester/cotton blend fabrics were artificially soiled with oily soils consisting of dirty motor oil, mineral oil, bacon grease, margarine, liquid vegetable oil, and suntan oil. These soiled swatches were then washed in a conventional washing machine using the wash-wear/permanent press cycle in 100° F. water of 7 grains/gallon hardness (as $CaCO_3$), and were dried and graded visually by a panel of judges for an estimate of the percent removal of the stain relative to stained but unwashed swatches. Average percent removal grades are given below for formulations of the cleaning system herein described. All formulations provided a 0.8% concentration of alkane and a 0.1% of sulfosuccinic diester emulsifier in the aqueous wash medium.

| Oily Soil Dissolving Agent<br>Ingredients | Average % Removal of All Soils |
|---|---|
| $C_{12}$—$C_{14}$ paraffin blend bis-tridecyl ester of sodium sulfosuccinate (invention) | 99+% |
| $C_{12}$ paraffin dihexyl ester of sodium sulfosuccinate (comparison) | 78% |
| $C_{12}$—$C_{14}$ paraffin blend dioctyl ester of sodium sulfosuccinate (comparison) | 63% |
| $C_{12}$ paraffin dioctyl ester of sodium sulfosuccinate (comparison) | 60% |
| Range of cleaning of typical laundry detergent product (comparison) | 50-60% |
| Typical cleaning of solvent dry cleaning process with pre-spotting of stains (comparison) | 100% |

The above evaluation indicated that the bis-tridecyl ester of sodium sulfosuccinate in a $C_{12-14}$ alkane delivers oily soil cleaning in an aqueous wash equivalent to dry cleaning. The more water-soluble (higher HLB) structures of the other emulsifiers provided substantially less satisfactory results.

The fabrics cleaned with the compositions above were not stripped of residual oily soil dissolving agent.

EXAMPLE II

The equilibrium distribution ratio of emulsifiers between an oil phase and a water phase is a useful indicator of their relative HLB's and suitability for use in the present invention. Since the method for experimental determination of an HLB value is tedious and relatively insensitive, emulsifiers for possible use in the practice of the present invention were evaluated for distribution of 2 parts of emulsifer between 18 parts of dodecane and 80 parts of water. The emulsifier was initially dissolved in the dodecane. The two phase system was then shaken to equilibrium and the separated layers were analyzed. Results are given for room temperature equilibrium. Values below were generated for emulsifiers used in Example 1:

| Ingredient | Percent of Emulsifier in Oil Phase |
|---|---|
| Dioctyl sulfosuccinate, sodium salt | 9% |
| (bis) tridecyl sulfosuccinate, sodium salt | 100% |

EXAMPLE III

Formula ingredients were screened for cleaning effectiveness in a reduced scale simulated washing machine about two liters in volume. Polyester/cotton blend swatches were soiled, cleaned at 70° F. in the aqueous washing media detailed below, and graded as in Example I. Percent cleaning grades of approximately 90% or higher in this test were considered "clean". Redeposition of the dark components of the oily soils along with the residual oily soil dissolving agent resulted in a darkening of otherwise clean polyester tracer swatches in the bath as shown by the depression of a mechanically read whiteness grade.

| Ingredients | Percent Soil Removal | Tracer Whiteness |
|---|---|---|
| 0.8% petroleum paraffin, ($C_{12}$—$C_{14}$) plus: | | |
| (1) 0.1% (bis) tridecyl sodium sulfosuccinate (invention) | 93% | 80 |
| (2) 0.1% dihexyl sodium sulfosuccinate (comparison) | 76% | 81 |
| (3) 0.1% dicoco dimethyl ammonium chloride (invention) | 89% | 75 |
| (4) 0.1% coco trimethyl ammonium chloride (comparison) | 53% | 81 |
| (5) 0.1% complex organic phosphate diester, sodium salt (invention) | 91% | — |
| (6) 0.1% polyethoxylated linear alcohol, $C_{17}H_{35}O(C_2H_4O)_2H$ (comparison 100° F.) | 47% | — |
| (7) No emulsifier added to dodecane (comparison) | 83% | 48 |

The results above provide three examples of emulsifier/solvent systems of the present invention. The relatively higher water solubility of the emulsifiers in Compositions Nos. 2 and 4 place them outside the desired performance range. The polyethoxylated alcohol (Composition No. 6) has a calculated HLB value of about 5, but does not possess the polyalkyl structure necessary for practice of the present invention.

Cleaning of the dodecane alone is shown, but the gross solvent phase deposition demonstrated by the low whiteness grade of the tracer is indicative of the need for an emulsifier to at least partially disperse the solvent phase in the wash. The cleaning grade here is deceptively high; the oily stains were largely obscured by the solvent deposition rather than being removed.

EXAMPLE IV

Small scale cleaning tests were performed to determine the effect of a stripping step on residual oily soil dissolving agent on fabrics. The procedure of Example III was generally followed, except that the oily soil dissolving agent was dyed with an oil-soluble red dye. The agent residual on rinsed and dried tracer fabrics was measured by the shift toward red intensity of reflectance values on a Hunter Color Difference Meter.

| Ingredients (wash conc.) | Shift in Hunter "a" value of washed vs. unwashed polyester tracer |
|---|---|
| (1) 0.8% Paraffin "F" (Exxon) ($C_{12-14}$ petroleum paraffin) | |

-continued

| Ingredients (wash conc.) | Shift in Hunter "a" value of washed vs. unwashed polyester tracer |
|---|---|
| 0.1% Emcol 4600 (active basis) by Witco [(bis) tridecyl sulfosuccinate sodium salt] | +9.0 |
| (2) Ingredients of NO. 1, plus: 0.13% Neodol 23-6.5 by Shell (ethoxylated $C_{12-13}$ alcohols) added 2 minutes after cleaning system | +3.4 |
| (3) Ingredients of NO. 1, plus: 0.13% Mg $(LAS)_2$ (magnesium-neutralized $C_{11.4}$ alkylbenzene sulfonate), added 2 minutes after cleaning system | +2.8 |
| (4) 0.8% Paraffin "F" 0.1% Emphos PS-21A by Witco (complex organic phosphate ester, acid) | +6.8 |
| (5) Ingredients of No. 4, plus: 0.13% Neodol 23-6.5 added 2 minutes after cleaning system | +3.6 |

The reduction of the residual solvent shown above was readily apparent by feel, smell, and appearance of the fabrics.

The importance of the delay of stripper was shown in a full scale washing machine cycle test wherein Composition No. 3 above was tested with the two minute delay and with the solvent stripping agent $Mg(LAS)_2$ added to the water simultaneously with the other ingredients;

| Stripper Surfactant: | Percent removal of oily soil stains |
|---|---|
| Added simultaneously | 72% |
| Added after two minutes delay | 94% |

As is apparent from these results, the immediate addition of a type of surfactant determined to be an effective solvent stripping agent causes interference with the cleaning process by stabilizing an oil-in-water emulsion too early in the cycle.

EXAMPLE V

Compositions formulated as follows are produced.

| | |
|---|---|
| Oily Soil Dissolving Agent | |
| Paraffin F (Exxon) | 84.7% |
| Sodium (bis) tridecyl sulfosuccinate | 10.5% |
| Ethanol | 2.0% |
| Water, perfume, & misc. | Remainder |
| Solvent Stripping Agent | |
| Sodium $C_{12}$ alkyl benzene sulfonate | 16% |
| Gelatinized cornstarch | 3% |
| Preservative and perfume | 0.24 |
| Water and miscellaneous | Remainder |

The above compositions are tested for their cleaning performance on a variety of stains. The contents of a bottle containing 500 milliliters of the oily soil dissolving agent are added to a washing machine containing 12 gallons of water at 40° C. and 5 garments intentionally soiled with oily soils, (dirty motor oil, mineral oil, suntan oil, liquid vegetable oil, bacon grease, and margarine).

Three minutes after the start of agitation and addition of the oily soil solvent, the contents of a bottle containing 350 milliliters of the solvent stripping agent are added to wash water. Agitation is continued for a total of 10 minutes and the programmed washing machine cycle of extraction, deep rinse, and spin dry extraction is completed.

All oily soils on the test garments are effectively removed. Residual stains are clearly evident on duplicate garments soiled in the same manner but washed with a conventional granular laundry detergent.

Ditallowdimethyl ammonium chloride, dicocodimethyl ammonium chloride methyl-1-stearylamidoethyl-2-stearylamido imidazolinium methyl sulfate, and the diester of phosphoric acid and a $C_{12-15}$ alcohol (sodium salt) are substituted on an equal weight basis for sodium(bis) tridecyl sulfosuccinate and substantially equivalent results are obtained.

EXAMPLE VI

The following compositions were produced and the evaluations are representative of the compositions of the present invention. Results were consistent with the excellent cleaning of oily soils and the low fabric residual solvent levels provided by the practice of the invention.

A

The solvent stripping agent in this evaluation was encapsulated in pharmaceutical gelatin capsules, size 000, with each capsule containing 1.24 g. of solvent stripping agent. The gelatin capsules were dropped into the bottle of oily soil dissolving agent and were observed to be unaffected by it. When this entire bottle was emptied into the wash water the capsules were observed to dissolve, and ruptured approximately 1 to 2 minutes after addition. Both effective cleaning and solvent removal were achieved on fabrics.

Oily Soil Dissolving Agent System Ingredients (wash conc.)

0.8% Paraffin "F"

0.1% Emcol 4600, dry basis (Witco Chemical Corp. trademark for (bis) tridecyl sulfosuccinate)

Stripping System Ingredient (wash conc.)

0.13% Neodol 23-6.5 (Shell Chemical Co. trademark for $C_{12-13}$ alcohol ethoxylated with an average of 6.5 moles of ethylene oxide per mole of alcohol) encapsulated in gelatin and immersed in the Oily Soil Dissolving Agent

B

The solvent stripping agent composition in this evaluation was processed into a dry granulated product and added to the wash at essentially the same time as the liquid oily soil dissolving agent. The slower kinetics of dissolution of the granule into the aqueous washing medium delayed effective entry of the stripping agent surfactant sufficiently to give overall results approximating a delayed addition of the surfactant.

Oily Soil Dissolving System Ingredients (wash conc.)

0.8% Paraffin "F"
0.1% Emcol 4600, dry basis

Solvent Stripping Agent System Ingredients (wash conc.)

0.325% of a granular product containing:
20% $Mg(LAS)_2$
40% $Na_2SO_4$
30% $MgSO_4$
3% $Na_2CO_3$
7% Water The solvent stripping agent in Example B is replaced by the following granular compositions:

1.
20% sodium $C_{12}$LAS (linear alkyl benzene sulfonate)
20% sodium sulfate
50% sodium tripolyphosphate
10% water 2.
6% sodium $C_{18}$ alkyl sulfate
6% sodium $C_{13}$ linear alkyl benzene sulfonate
6% sodium $C_{14-16}$ alkyl triethoxy sulfate
12% sodium silicate
30% sodium sulfate
30% sodium carbonate
10% water Substantially similar results are obtained.

A further delay in delivery of the solvent stripping agent to the aqueous washing medium in Example B is achieved by enclosing the granular product in a packet of water-soluble film. Examples of suitable film materials are polyvinyl alcohol and gelatin.

EXAMPLE VII

The Paraffin "F" of Example VI is replaced with isopropyl myristate, with the methyl ester of coconut fatty acid, and with kerosene. Substantially the same effective cleaning and solvent removal are obtained.

EXAMPLE VIII

The concentration of Paraffin "F" in Example VI is reduced to 0.4% in the aqueous washing medium and the concentration of Emcol 4600 is reduced to 0.05%. When used with a solvent stripping agent providing 0.1% of sodium $C_{12}$ alkyl benzene sulfonate effective cleaning and solvent removal are obtained.

EXAMPLE IX

Compositions formulated as follows are produced.

| | |
|---|---|
| Oily Soil Dissolving Agent | |
| Paraffin F (Exxon) | 89% |
| Ditallowdimethyl ammonium chloride | 8% |
| Isopropyl Alcohol | 2% |
| Solvent Stripping Agent | |
| $C_{9-11}$(EO) 8 - i.e. $C_{9-11}$alcohol condensed with an average of 8 moles of ethylene oxide | 30% |
| Gelatinized cornstarch | 2% |
| Ditallowdimethyl ammonium chloride | 0.5% |
| Ethylene oxide terephthalate copolymer | 5% |
| Water & misc. | remainder |

The above compositions are tested for their cleaning performance on a variety of stains. The contents of a bottle containing 500 milliliters of the oily soil dissolving agent are added to a washing machine containing 12 gallons of water at 40° C. and 5 garments intentionally soiled with oily soils, (dirty motor oil, mineral oil, suntan oil, liquid vegetable oil, bacon grease, and margarine).

Three minutes after the start of agitation and addition of the oily soil solvent, the contents of a bottle containing 350 milliliters of the solvent stripping agent are added to wash water. Agitation is continued for a total of 10 minutes and the programmed washing machine cycle of extraction, deep rinse, and spin dry extraction is completed. All oily soils on the test garments are effectively removed. Residual stains are clearly evident on duplicate garments soiled in the same manner but washed with a conventional granular laundry detergent.

The solvent stripping agent is replaced by the following composition:

| | |
|---|---|
| $C_{9-11}$ $(EO)_8$ | 33% |
| Triethanolamine | 11% |
| $C_{11-12}$ linear alkyl benzene sulfonic acid | 11% |
| Oleic acid | 1% |
| Ethanol | 5% |
| Potassium hydroxide | 1.8% |
| Citric acid | 0.1% |
| Water & Misc. | Balance |

Substantially the same cleaning results are obtained. Fabric texture and "body" subjectively graded is considered somewhat less desirable.

What is claimed is:

1. A cleaning product composition for removing oily soil from fabrics in an aqueous washing medium consisting essentially of:

(1) a discrete unit of an oily soil dissolving agent consisting essentially of:

(a) from about 20% to about 97% by weight of a water-insoluble solvent selected from the group consisting of:

(i) alkanes and alkenes having a flash point not lower than about 65° C. (Tag closed cup), an initial boiling point not lower than about 130° C., a solidification point not above about 20° C. and a carbon chain length from about 10 to about 18; and

(ii) fatty acid esters of the formula $$R_1-\overset{\overset{\displaystyle O}{\|}}{C}-O-R_2,$$

in which $R_1$ is an alkyl group with from about 7 to about 17 carbon atoms and $R_2$ is an alkyl group with from 1 to about 10 carbon atoms, the sum of carbon atoms in $R_1$ and $R_2$ being from about 8 to about 23;

(b) from about 3% to about 30% by weight of a water-in-oil emulsifier soluble in said solvent, said emulsifier having an HLB value of from about 2 to about 12 and consisting essentially of from about 25% to 100% of emulsifier compounds with at least two alkyl groups each having from about 9 to about 20 carbon atoms and selected from the group consisting of:

(i) dialkyl sulfosuccinic acid and alkali metal, alkaline earth metal, ammonium, and mono-, di-, and tri-$C_{1-4}$ alkyl and alkanol ammonium salts of dialkyl sulfosuccinic acid, said alkyl groups each containing from about 9 to about 20 carbon atoms;

(ii) quaternary ammonium compounds with more than one long chain alkyl group selected from the group consisting of di-$C_{9-20}$ alkyl ammonium chloride, bromide, methyl sulfate, nitrate and acetate and di-$C_{9-20}$ alkyl imadazolinium quaternary ammonium compounds;

(iii) alkyl or alkyl ethoxy diesters of phosphoric acid having the formula $$MO-\overset{\overset{\displaystyle O}{\|}}{\underset{\underset{\displaystyle O(C_2H_4O)_nR_1}{|}}{P}}-O(C_2H_4O)_mR_2$$

in which both $R_1$ and $R_2$ are alkyl groups containing from about 9 to about 20 carbon atoms, n and m are from zero to about 8 and M is hydrogen or a salt forming cation, and (iv) mixtures thereof;

(c) from 0% to about 77% water; and (d) from 0% to about 77% detergency builders selected from the group consisting of water soluble orthophosphates, polyphosphates, phosphonates, carbonates, bicarbonates, polyhydroxysulfonates, silicates, carboxylates and polycarboxylates, water-insoluble aluminosilicates and mixtures thereof, (2) a discrete unit or units of a solvent stripping agent consisting essentially of from about 5% to 100% of a water-soluble surfactant having an HLB value of from about 11 to about 18, selected from the group consisting of anionic, nonionic, zwitterionic, amphoteric and cationic surfactants and mixtures thereof, from 0% to about 95% water and from 0% to about 95% detergency builders selected from the group consisting of water soluble orthophosphates, polyphosphates, phosphonates, carbonates, bicarbonates, polyhydroxysulfonates, silicates, carboxylates and polycarboxylates, water-insoluble aluminosilicates and mixtures thereof, said discrete unit comprising from about 10% to about 80% by weight of the total cleaning product.

2. The composition of claim 1 wherein said oily soil dissolving agent consists essentially of from about 50% to about 95% of said solvent and from about 5% to about 20% of said emulsifier.

3. The composition of claim 1 wherein said solvent stripping agent is an aqueous solution consisting essentially of from about 10% to about 50% of an anionic surfactant selected from the group consisting of alkyl sulfates, alkyl benzene sulfonates, and alkyl polyoxyether sulfates, said alkyl groups having from about 10 to about 20 carbon atoms and said polyoxyether group having an average of from about 2 to about 4 moles of ethylene oxide and from about 50% to about 90% water.

4. The composition of claim 1 wherein said solvent stripping agent additionally consists essentially of from about 0.5% to about 15% of a fabric sizing agent selected from the group consisting of gelatinized starch and partially gelatinized starch and from 0% to about 3% of a quaternary ammonium fabric softening and antistatic agent selected from the group consisting of (a) compounds having the formula

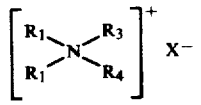

wherein $R_1$ is hydrogen or an aliphatic group of from 1 to 22 carbon atoms; $R_2$ is an aliphatic group having from 12 to 22 carbon atoms; $R_3$ and $R_4$ are each alkyl groups of from 1 to 3 carbon atoms; and X is an anion selected from halogen, acetate, phosphate, nitrate and methyl sulfate radicals;

(b) compounds having the formula

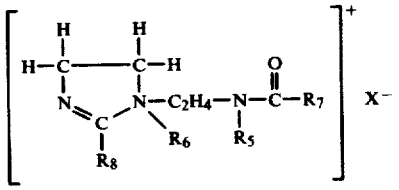

wherein $R_6$ is an alkyl containing from 1 to 4, preferably from 1 to 2 carbon atoms, $R_5$ is an alkyl containing from 1 to 4 carbon atoms or a hydrogen radical, $R_8$ is an alkyl containing from 1 to 22, preferably at least 15 carbon atoms, and X is an anion; and (c) mixtures thereof.

5. The composition of claim 1 wherein said solvent is an alkane with an average of from about 10 to about 16 carbon atoms.

6. The composition of claim 5 wherein said oily soil dissolving agent consists essentially of from about 50% to about 95% of said solvent and from about 5% to about 20% of said emulsifier.

7. The composition of claim 1 wherein said solvent stripping agent is incorporated into said discrete unit of oily soil dissolving agent but is restrained from intimate mixing with said oily soil dissolving agent by a barrier material insoluble in said oily soil dissolving agent selected from the group consisting of gelatin and polyvinyl alcohol.

8. The composition of claim 7 wherein said discrete unit of oily soil dissolving agent is from about 75 grams to about 1000 grams and said solvent stripping agent is from about 50 grams to about 1000 grams.

9. A method of removing oily soil from fabrics consisting essentially of:

(1) contacting said fabrics with an aqueous washing medium consisting essentially of:

(a) from about 0.01% to about 3% by weight of a water-insoluble solvent selected from the group consisting of:

(i) alkanes and alkenes having a flash point not lower than about 65° C. (Tag closed cup), an initial boiling point not lower than about 130° C., a solidification point not above about 20° C. and a carbon chain length from about 10 to about 18; and (ii) fatty acid esters of the formula

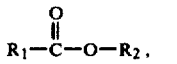

in which $R_1$ is an alkyl group with from about 7 to about 17 carbon atoms and $R_2$ is an alkyl group with from 1 to about 10 carbon atoms, the sum of carbon atoms in $R_1$ and $R_2$ being from about 8 to about 23;

(b) from about 0.01% to about 0.5% by weight of a water-in-oil emulsifier soluble in said water-insoluble solvent having an HLB value of from about 2 to about 12 and consisting essentially of from about 25% to 100% of emulsifier compounds with at least two alkyl groups each having from about 9 carbon atoms to about 20 carbon atoms and selected from the group consisting of:

(i) dialkyl sulfosuccinic acid and alkali metal, alkaline earth metal, ammonium, and mono-, di-, and tri-$C_{1-4}$ alkyl and alkanol ammonium salts of dialkyl sulfosuccinic acid, said alkyl groups each containing from about 9 to about 20 carbon atoms;

(ii) quaternary ammonium compounds with more than one long chain alkyl group selected from the group consisting of di-$C_{9-20}$ alkyl ammonium chloride, bromide, methyl sulfate, nitrate and acetate and di-$C_{9-20}$ alkyl imadazolinium quaternary ammonium compounds;

(iii) alkyl or alkyl ethoxy diesters of phosphoric acid having the formula

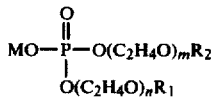

in which Both $R_1$ and $R_2$ are alkyl groups containing from about 9 to about 20 carbon atoms, n and m are from zero to about 8 and M is hydrogen or a salt forming cation, and (iv) mixtures thereof; and (c) from about 90% to about 99.6% water;

(2) allowing said fabrics to remain in contact with said washing medium for at least 30 seconds; and (3) adding or releasing to said aqueous medium containing said fabric from about 0.01% to about 1% by weight of a water-soluble surfactant having an HLB value of from about 11 to about 18, selected from the group consisting of anionic, nonionic, zwitterionic, amphoteric and cationic surfactants and mixtures thereof.

10. The method of claim 9 wherein the concentration of said solvent is from about 0.2% to about 1.2%, the concentration of said water-in-oil emulsifier is from about 0.02% to about 0.2% and the concentration of said water-soluble surfactant is from about 0.02% to about 0.5%.

11. The method of claim 9 wherein the concentration of said solvent is about 0.8% the concentration of said water-in-oil emulsifier is about 0.1% and the concentration of said water-soluble surfactant is from about 0.05% to about 0.15%.

12. The method of claim 9 which additionally consists essentially of adding or releasing to said aqueous medium with said water-soluble surfactant or any time thereafter from about 0.005% to about 0.5% of a fabric sizing agent selected from the group consisting of gelatinized starch and partially gelatinized starch and from 0% to about 0.1% of a quaternary ammonium fabric softening and anti-static agent selected from the group consisting of (a) compounds having the formula

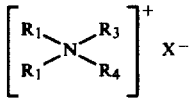

wherein $R_1$ is hydrogen or an aliphatic group of from 1 to 22 carbon atoms; $R_2$ is an aliphatic group having from 12 to 22 carbon atoms; $R_3$ and $R_4$ are each alkyl groups of from 1 to 3 carbon atoms; and X is an anion selected from halogen, acetate, phosphate, nitrate and methyl sulfate radicals;

(b) compounds having the formula

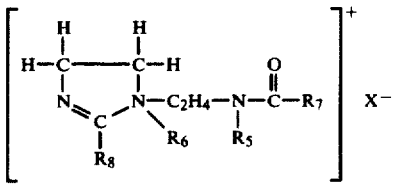

wherein $R_6$ is an alkyl containing from 1 to 4, preferably from 1 to 2 carbon atoms, $R_5$ is an alkyl containing from 1 to 4 carbon atoms or a hydrogen radical, $R_8$ is an alkyl containing from 1 to 22, preferably at least 15 carbon atoms, and X is an anion; and (c) mixtures thereof.

13. The method of claim 9 wherein said solvent is an alkane with an average of from about 10 to about 16 carbon atoms.

14. The method of claim 13 wherein said solvent stripping agent comprise an anionic surfactant selected from the group consisting of alkyl sulfates, alkyl benzene sulfonates, and alkyl polyoxyether sulfates, said alkyl groups having from about 10 to about 20 carbon atoms and said polyoxyether group having an average of from about 2 to about 4 moles of ethylene oxide.

* * * * *